US007721669B1

(12) United States Patent
Portmann et al.

(10) Patent No.: US 7,721,669 B1
(45) Date of Patent: May 25, 2010

(54) COMMON PAYLOAD RAIL FOR UNMANNED VEHICLES

(75) Inventors: Helmut Portmann, Panama City, FL (US); Elan Moritz, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 283 days.

(21) Appl. No.: 12/002,855

(22) Filed: Dec. 13, 2007

(51) Int. Cl.
*B63B 21/66* (2006.01)

(52) U.S. Cl. ..... 114/322

(58) Field of Classification Search ..... 114/77 A, 114/77 R, 312–342, 239; 244/135 R, 137.4; 701/21

See application file for complete search history.

(56) References Cited

U.S. PATENT DOCUMENTS 3,368,510 A * 2/1968 Humphrey ..... 114/317
4,449,472 A * 5/1984 Meyer, Jr. ..... 114/274
4,476,798 A * 10/1984 Backus ..... 114/77 R
6,854,410 B1 * 2/2005 King et al. ..... 114/244
2004/0149194 A1 * 8/2004 Schmidt et al. ..... 114/60
2006/0005759 A1 * 1/2006 Harland-White ..... 114/321

* cited by examiner

*Primary Examiner*—Ed Swinehart
(74) *Attorney, Agent, or Firm*—James T. Shepherd

(57) ABSTRACT

A common payload rail externally supports a submerged payload from an unmanned marine vehicle. A vehicle interface module has a conforming surface rigidly secured to the unmanned vehicle and feed-through conduits. A functionality module is secured to the vehicle interface module and contains internal interfacing components to minimize or eliminate any modifications to the payload and vehicle. A payload interface module having feed-through conduits is secured to the functionality module and has longitudinally extending rail structures sized to engage correspondingly shaped longitudinally extending receiving means on the payload. The longitudinally extending rail structures are shaped to extend into longitudinally extending receiving means on the payload to arrest lateral displacement between the payload interface module and the payload and at least one securing mechanism on the payload interface module is disposed to engage the payload to arrest longitudinal displacement between the payload interface module and the payload.

12 Claims, 5 Drawing Sheets

COMMON PAYLOAD RAIL FOR UNMANNED VEHICLES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention is for a common payload rail for securing an added payload capability to increase the versatility of unmanned vehicles (UV). More particularly, this invention secures an added payload capability externally to unmanned systems such as unmanned undersea vehicles (UUVs) and unmanned sea-surface vehicles (USVs) with minimal modifications required to the internals of the unmanned system.

Contemporary methods for increasing or improving the payloads for UUVs usually involve the insertion of additional payloads within the system. This procedure frequently required space that may not be available and often involved extensive and costly modifications to internal systems in the vehicle. Later developed external payloads for USVs are generally suspended by support systems and towed behind the vehicle. The added-on support and handling systems are usually unique and expensive to construct and install and can compromise the effectiveness of the host unmanned UV.

Thus, in accordance with this inventive concept, a need has been recognized in the state of the art for an efficient capability to directly mount a variety of external payloads to a submerged vessel or the underside of a surface vessel or on an outrigger off the side of the vessel via a rapidly and inexpensively installed common payload rail having the payloads designed for selective connection and disconnection.

SUMMARY OF THE INVENTION

The present invention provides a common payload rail to connect external payloads to a UV such as a UUV or USV. The common payload rail has a vehicle interface module having a conforming surface rigidly secured to the unmanned vehicle and feed-through conduits. A functionality module is secured to the vehicle interface module and has internal interfacing components to minimize or eliminate any modifications to the payload and vehicle. A payload interface module having feed-through conduits is secured to the functionality module and has longitudinally extending rail structure sized to engage correspondingly shaped longitudinally extending receiving means on the payload. The longitudinally extending rail structure is shaped to extend into the longitudinally extending receiving means on the payload to arrest lateral displacement between the payload interface module and the payload. At least one securing mechanism on the payload interface module is disposed to engage the payload to arrest longitudinal displacement between the payload interface module and the payload. The feed-through conduits extending through the payload interface module and the vehicle interface module receive select ones of electrical conductors and optical fibers for power and data transmission and other communication requirements of the payload, functionality module, and unmanned vehicle. Some of the feed-through conduits can include tubes to transfer fluids between the payload, functionality module, and unmanned vehicle. The vehicle interface module, functionality module and payload interface module have essentially protuberance-free outer surfaces provided with tapered leading and trailing edges to reduce hydrodynamic drag. The longitudinally extending rail structure has a cross-sectional L-shape and the longitudinally extending receiving means is an L-shaped channel sized to slideably receive the L-shaped longitudinally extending rail structure. Preferably, the longitudinally extending rail structure is a pair of upward-extending, sliding-rail structures extending in an inverted, oppositely-facing L-shaped cross-sectional configuration and longitudinally extending on the payload interface module. The longitudinally extending receiving means is shaped as a pair of L-shaped channels that longitudinally extend in the lower part of the bottom assembly of the payload. The L-shaped channels are slightly larger than the pair of L-shaped sliding rail structures to allow the L-shaped sliding rail structures to be inserted in and contiguously slid within the L-shaped channels. The internal components' of the functionality module can include a variety of self-contained internal power source components to power its own internal components and the external payload. Computer data and signal processing components, including data storage components, to store and process the data sensed and collected by the payload can be included, and sensor components can be included to provide input data to augment the unmanned vehicle and the external payload; the computer components, including data processing and data storage components, may also be arranged to make the functionality module a payload of its own.

An object of the invention is to provide a common payload rail for externally securing a payload on an unmanned vehicle.

Another object of the invention is to provide a cost effective common payload rail for externally increasing or modifying payload capability of existing UUVs and USVs in inventory.

Another object of the invention is to provide a common payload rail for externally securing a payload to an unmanned vehicle and interfacing electrical, electronic, and hydraulic support functions in a rapid and inexpensive installation.

Another object of the invention is to provide a common payload rail for externally securing a payload to the underside or outriggers on USVs or the topsides of UUVs.

Another object of the invention is to provide a common payload rail for mounting payloads externally on UVs to avoid expensive, time consuming modification of the limited interior volume of the UV or displacement of other internal UV systems.

Another object of the invention is to provide a common payload rail for mounting payloads externally on a UV for increased design efficiency and reduced overall system acquisition costs.

Another object of the invention is to provide a standard interface design that permits uncomplicated and easy "slide-on/slide-off" replacement of components on a UVs rather than opening up a UV and endangering the integrity of certified vehicles/systems.

Another object of the invention is to provide a common payload rail for mounting payloads externally on UVs allowing a large number of future payloads to be developed and attached with ease to older generation UVs.

These and other objects of the invention will become more readily apparent from the ensuing specification when taken in conjunction with the appended claims.

DESCRIPTION OF THE PREFERRED EMBODIMENT

Figure 1:
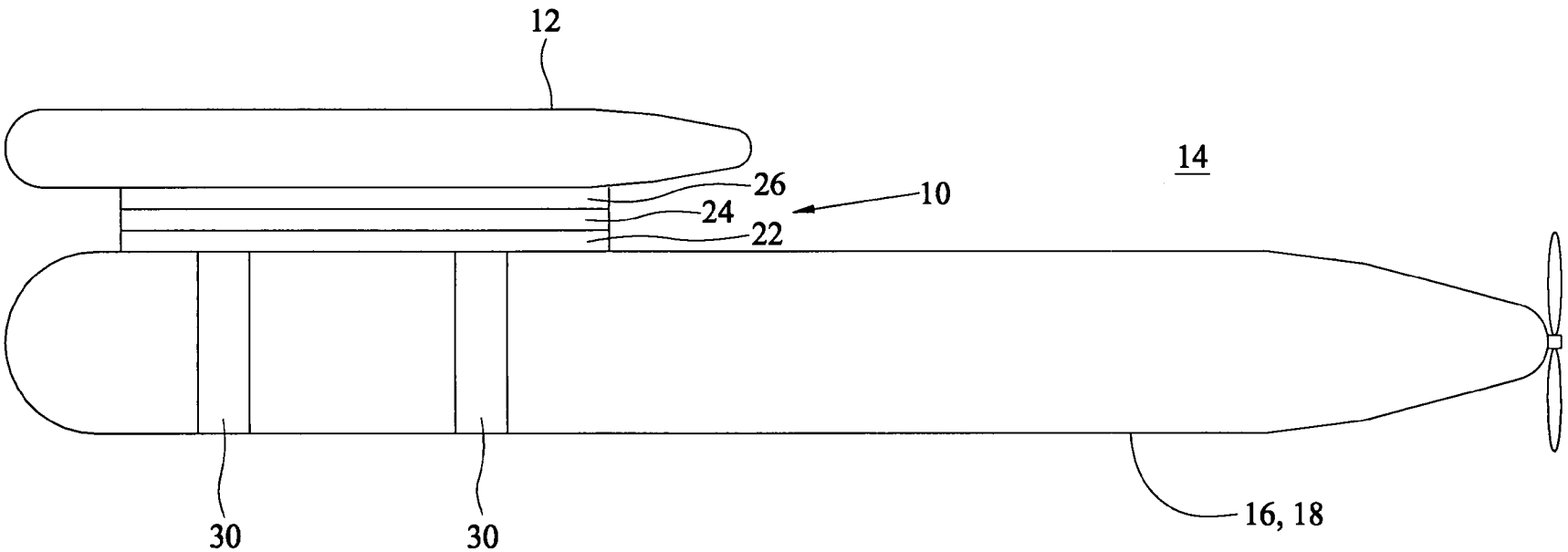
FIG. 1 is a schematic side view of the common payload rail of the invention mounting a submerged external payload shown partially in cross-section toward the front of a UUV.
Figure 2:
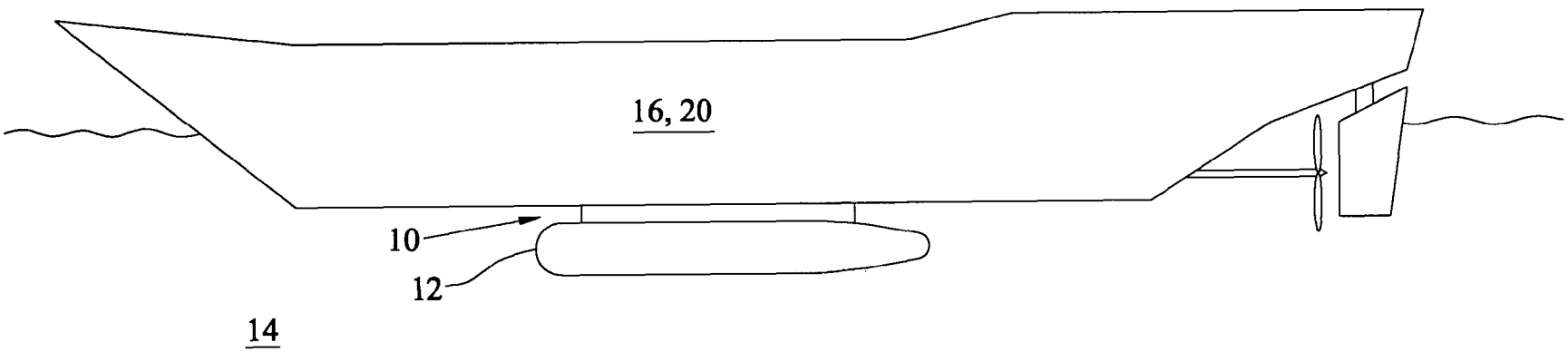
FIG. 2 is a schematic side view of the common payload rail of the invention mounting an external payload on the bottom of the hull of a USV.

Referring to FIGS. 1 and 2, common payload rail 10 of the invention is used to externally mount a variety of payloads 12 submerged in water 14 on an unmanned vehicle (UV) 16 such as an unmanned undersea vehicle (UUV) 18 or an unmanned surface vehicle 20. Common payload rail 10 provides a means to secure and add payload capability externally to host vehicle UVs with minimal effort and virtually no internal modifications of the UVs and no requirements to occupy space inside the UVs. In other words, common payload rail 10 attaches externally to the surface of host vehicles such as UUV 18 or USV 20, as well as on manned vessels and crafts, and then provides a standard mechanical, electrical, electronic, and hydraulic mating surface for external payloads 12 that are designed and built to meet the common mating interface standard of common payload rail 10.

Figure 3:
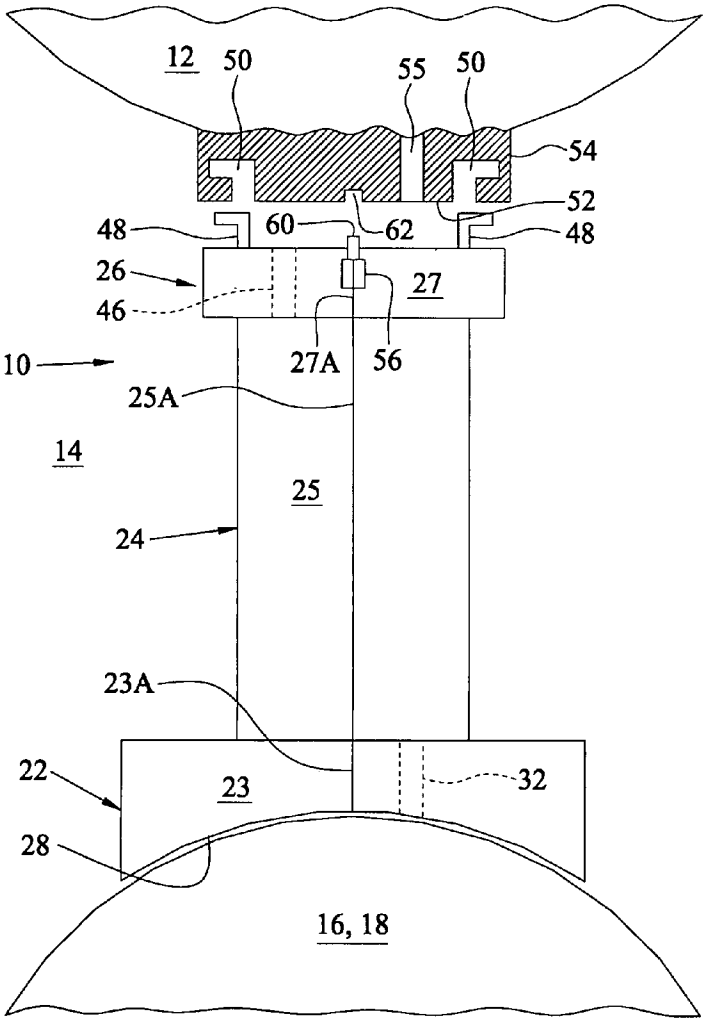
FIG. 3 is an end view of the common payload rail of the invention with the bottom assembly of the payload shown partially in cross-section.
Figure 4:
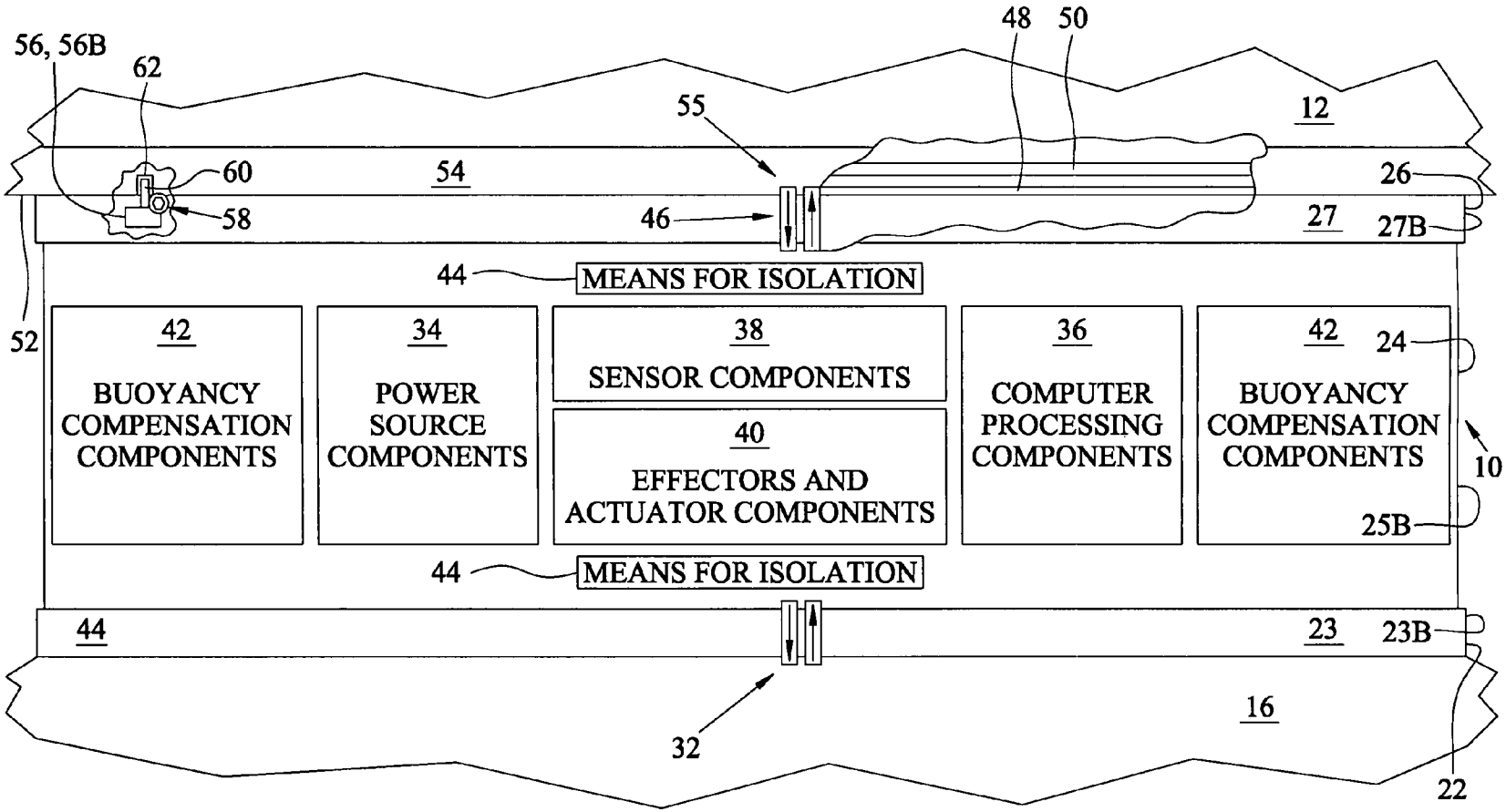
FIG. 4 is a side view of the common payload rail of the invention showing in cross section typical inherent attributes and functional capabilities of components contained in the functionality module.

Referring also to FIGS. 3 and 4, common payload rail 10 is schematically depicted as having three mutually connectable modules. These modules, a vehicle interface module 22, a functionality module 24, and a payload interface module 26 can be tailored to meet the needs of many different payloads 12 on a wide variety of UVs. In this regard, the leading and trailing edges of modules 22, 24 and 26 can be tapered and the longitudinal and lateral cross-sectional configurations of modules 22, 24 and 26 can be appropriately hydrodynamically shaped along their longitudinal lengths to minimize hydrodynamic drag to further minimize adverse impacts on the handling and performance of UV 16.

Vehicle interface module 22 can be considered as an extension of UV 16 and is preferably made from strong, corrosion resistant, or non-corrosive materials to support the static and dynamic loads of modules 24 and 26 and payload 12. Vehicle interface module 22 has an essentially protuberance-free outer surface 23 provided with a tapered leading edge 23A and trailing edge 23B to reduce hydrodynamic drag of payload rail 10. Vehicle interface module 22 has an inner conforming surface 28 shaped to accommodate and be secured to the specific UV 16 of interest. This conforming surface 28 can be attached to, or fastened onto, UV 16 via a number of different means alone or in combination. For example, these means can include epoxy and other strong adhesives adhered to and cured between conforming surface 28 and the surface of UV 16 and/or securing surface 28 to the surface of UV 16 with sealed screws, bolts, or other appropriate fasteners. FIG. 1 shows yet another way of attaching surface 28 of vehicle interface module 22 to a torpedo-shaped UUV 18 using two tensioned metal bands 30 that are connected to vehicle interface module 22 and extend around the circumference of UUV 18. The common payload rail 10 is thereby fastened to UUV 18 by bands 30

Vehicle interface module 22 has one or more feed-through conduits 32 extending through it and between UV 16 and payload rail 10 to receive select ones of electrical conductors and optical fibers for at least some of the power and data transmission and communication requirements of payload 12, functionality module 24, and UV 16. Some of conduits 32 also can be used as tubes to transfer at least some of fluids such as liquid and gaseous petroleum fuel products or other gases among payload 12, functionality module 24, and UV 16.

Functionality module 24 is securely connected to vehicle interface module 22 by any of a wide variety of well known means and is also preferably made from strong, corrosion resistant, or non-corrosive materials to support the static and dynamic loads of payload interface module 26 and payload 12. Functionality module 24 preferably has a protuberance-free outer surface 25 having a tapered leading edge 25A and trailing edge 25B to create an elongate, strut-like streamlined shape for reduction of hydrodynamic drag of payload rail 10 and to reduce the effects of payload rail 10 on the dynamic handling of UV 16.

Referring to FIG. 4, functionality module 24 can contain internal components that can help efficiently perform functions of payload rail 10 that expedite its successful operation. These internal components do not interfere with payload rail 10 as it quickly interfaces with payload 12 and the host UV 16 and require no or minimal modifications to either of them. These functional components of functionality module 24 can include, but are not limited to: self contained internal power source components 34 such as battery power, fuel cell power, or more exotic sources like flywheel inertial stored power, to provide power to both its own internal components as well as for external payload 12; general and custom analog and digital computer data and signal processing components 36, including data storage components, to process payload data and its own generated data and produce effects as required; sensor components 38 that can themselves provide input data to augment the UV 16 or the external payload 12 (in effect, making common payload rail 10 a payload of its own); and effectors and actuator components 40 to produce ambient effects as needed, such as chaff or other ejections, acoustical/optical effects, drag reduction, etc.

Functionality module 24 can also contain buoyancy compensation components 42 that can include small reservoir tanks, miniature pumps, valves, actuators, and piping. These buoyancy compensation components 42 can be appropriately actuated to modify the impact of the assembled payload rail 10 and payload 12 on the center of gravity and buoyancy of UV 16 and, consequently, its handling and performance. Functionality module 24 can also include appropriate means for isolation 44 of the effects of vibrations throughout payload interface module 26 and vehicle interface module 22 to dampen vibrations from UV 16 to payload 12 or vice versa. This isolation can minimize impact on sensor components 38 or those sensors of UV 16 and payload 12. The isolation means 44 can also have electrical, electro-magnetic, magnetic, and/or acoustical components to minimize impact of the effects of one system or the other, and if necessary, shield and isolate any emissions or emanations from one body to another, and/or compensate for these effects to yield an overall lower detectable radiated signal to remote sensing devices. Components 34, 36, 38, 40, 42, and 44 can be appropriately placed in functionality module 24 by one skilled in the art to assure acceptable ballasting/center-of-gravity/buoyancy/trim and hydrodynamic handling characteristics among payload rail 10, payload 12, and UV 16 and to otherwise make available their intended functional capabilities. It is therefore understood that the arrangement of such components depicted in FIG. 4 is to facilitate an understanding of this inventive concept and is not to be regarded as being limiting.

Signal and power connectivity is provided between and among internal components 34, 36, 38, 40, 42, 44, external payload 12, and UV 16. This includes internal wiring and connectors embedded in both interface modules 26 and 22. This also includes appropriate units for electrical, optical, fluidic, hydraulic, opto-electronic, and electro-magnetic communications and passing of data through feed-through conduits 46 in payload interface module 26 between external payload 12 and payload rail 10 and through feed-through conduits 32 between UV 16 and payload rail 10. The internal wiring and connectors are fabricated, installed and interconnected using materials and procedures well established in the art.

Figure 5:
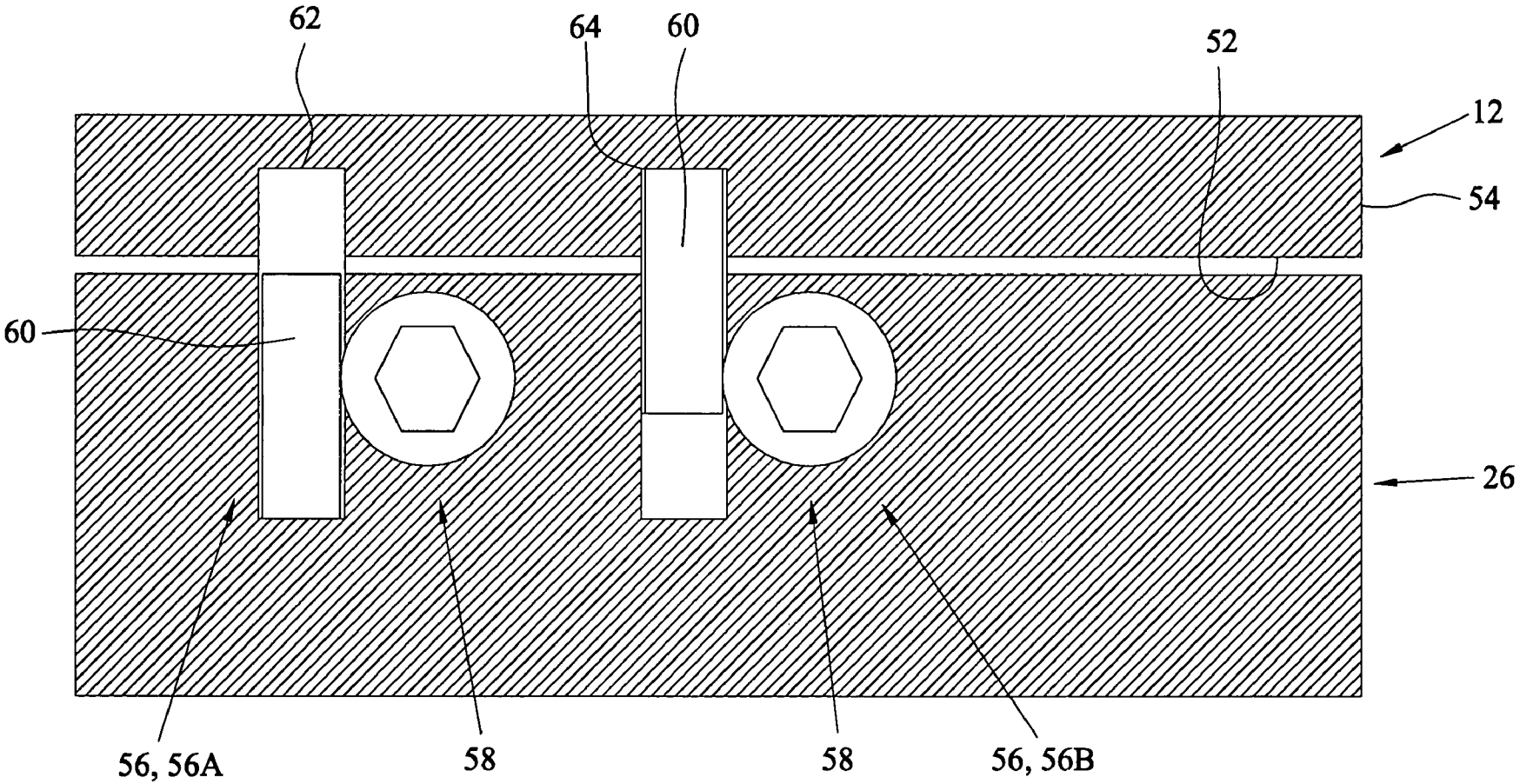
FIG. 5 is a schematic side view of details of an exemplary securing mechanism for the common payload rail of the invention.

Referring to FIGS. 3, 4 and 5, structural and mechanical support of payload 12 on UV 16 is provided for by payload interface module 26 that is rigidly secured to functionality module 24. Payload interface module 26 is preferably made from strong, corrosion resistant, or non-corrosive materials to support the load of payload 12. Payload interface module 26 also has an essentially protuberance-free outer surface 27 provided with a tapered leading edge 27A and trailing edge 27B to reduce hydrodynamic drag of payload rail 10. One or more feed-through conduits extending through payload interface module 26 and between UV 16 and payload rail 10 receive select ones of electrical conductors and/or optical fibers for at least some of the power, data and/or communication needs of payload 12, functionality module 24, and UV 16. Some of feed-through conduits 46 as well as feed-through conduits 32 may find use as transfer tubes for various liquids and gasses among payload 12, functionality module 24, and UV 16.

Payload interface module 26 of payload rail 10 assures that payload 12 remains securely in place during operation and that payload 12 can be easily and quickly installed and removed. Payload interface module 26 has a pair of upward-extending, sliding-rail structures 48 made of metal or other rugged, strong material extending in an inverted, oppositely-facing L-shaped cross-sectional configuration. L-shaped sliding rail structures 48 of payload interface module 26 longitudinally extend all the way or at least a portion of the way along the length of module 26 to. L-shaped sliding rail structures 48 are disposed to be slideably received in a pair of slightly larger L-shaped channels 50 that longitudinally extend along a lower part 52 of a bottom assembly 54 of payload 12. The slightly larger shape of L-shaped channels 50 allows L-shaped sliding rail structures 48 to be inserted into and contiguously slid within the L-shaped channels 50 of bottom assembly 54. The locations of the L-shaped channels 50 and the rail structures 48 on module 26 and bottom assembly 54 can be reversed to produce substantially the same results.

Depending on their relative lengths, L-shaped channels 50 in bottom assembly 54 can contain some or all of the entire lengths of L-shaped structures 48 of payload interface module 26. The contiguous abutting relationship between structures 48 and channels 50 laterally secure and arrest payload 12 on UV 16 via payload rail 10. Longitudinal securing of payload 12 on UV 16 via payload rail 10 is assured by including at least one securing mechanism 56 in payload interface module 26. Securing mechanism 56 can be quickly actuated to engage bottom assembly 54 of payload 12 to longitudinally secure payload 12 to payload rail 10 and, thus, UV 16.

Figure 6:
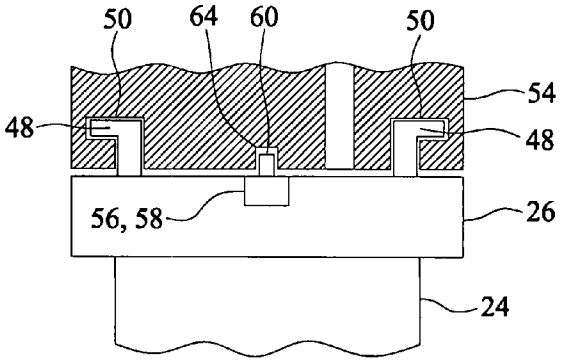
FIG. 6 is an end view of the common payload rail of the invention with the bottom assembly of the payload shown partially in cross-section with the upwardly extending inverted L-shaped rails of the payload rail engaging the L-shaped channels of the payload.

Referring also to FIG. 5, two exemplary securing mechanisms 56, designated 56A and 56B, are shown although more or less than two such mechanisms can be used so long as the number chosen can securely couple payload rail 10 to payload 12. Each securing mechanism 56A, 56B in payload interface module 26 has an interconnected hex-key geared sub-mechanism 58 rotated to selectively outwardly and inwardly displace an extensible pin 60 to engage recess 62 or 64. Securing mechanism 56A is shown having its pin 60 in the retracted position not engaging recess 62 in lower part 52 of bottom assembly 54. Securing mechanism 56B is shown having its pin 60 in the extended position engaging recess 64 in lower part 52 of bottom assembly 54. The engagement of recess 64 in bottom assembly 54 of payload 12 by pin 60 of securing mechanism 56B in payload rail 10 prevents payload 12 from longitudinally sliding relatively to UV 16, see also FIGS. 4 and 6, and, simultaneously, the mechanical co-action between L-shaped sliding rail structures 48 and L-shaped channels 50 prevents virtually any lateral or yawing motions. Thus payload 12 is secured to UV 16 via common payload rail 10 of the invention.

The pair of longitudinally extending L-shaped rail structures 48 and mating L-shaped channels 50 could be reversed on module 26 and bottom assembly 54 of payload 12 or one of each could be used. The rail structures and mating channels could have other configurations including separated structural extensions that allow for quick engagement and release of payload 12 to payload rail 10. These could be one or more rounded or square projections on either payload interface module 26 or payload 12 that can engage round or square shaped channels, or a series of projections engaging clamps or clasping receptacles or other engaging means. Electric or unassisted magnetic engaging components may also be used between payload interface module 26 and bottom assembly 54 of payload 12. A feed-through conduit 55 for mating conductors, tubes and connectors is provided in bottom assembly 54 for the transfer of electromagnetic power and data as well as fluids between payload rail 10 and payload 12.

The arrangement of L-shaped rail structures 48 and mating L-shaped channels 50 can have securing mechanisms 56 provided with sub-assemblies 58 that can be quickly manually actuated to pull any pins 60 that are engaging any recesses in bottom assembly 54. This permits payload 12 to be quickly longitudinally displaced to release structures 48 from channels 50. The current payload 12 can be quickly removed and replaced by another payload without any other mechanical complications. Quick-disconnect securing mechanisms other than those described above also can be used to secure payload 12 to payload rail 10 and will readily suggest themselves to one skilled in the art to which this invention pertains. The literature is replete with such securing means and fasteners whose design and specifications are openly published to become a standard to which bottom assemblies on different UV payloads can then be designed and constructed.

Common payload rail 10 of the invention can be adapted to UVs of many different types and can also be used with manned vehicles as well. FIG. 1 shows a rapidly changeable payload 12 mounted above and on the dorsal centerline of a UUV 18 submerged in water and FIG. 2 shows a submerged external payload 12 mounted on USV 20 below its longitudinally extending centerline. One or more of these payloads 12 could be mounted as shown and/or in an outrigger disposition by one or more payload rails 10, provided that appropriate ballasting is provided to counterweight their effect. All of these adaptations of payload rail 10 can increase performance capabilities of the host vehicles in a way that enables current and future host vehicles to benefit from continuing technological advances, and allows them to better meet future requirements, in cost effective and timely ways.

Common payload rail 10 of the invention provides an uncomplicated and reliable "bridging mechanism" that allows coupling of essentially different, arbitrary payloads externally to a wide variety of host vehicles utilizing a standard coupling approach.

Common payload rail 10 will increase flexibility for utilizing payloads with a much broader number of varied UVs at potentially significant savings if payloads are designed and constructed to meet the open interface specification. Payload rail 10 can allow external placement of components that have been carried internally in the current generation of UVs, leaving internal spaces for other components.

Payload rail 10 can increase design efficiency and reduce overall system acquisition costs by providing a standard interface design using components that can be designed separately from the UV itself, and can be mated to any UV that incorporates the same interface design. This feature of payload rail 10 provides enhanced design flexibility, and allows for the interchangeability of components without having to open up or make modifications to the UV. Payload rail 10 allows a large number of future payloads to be developed and attached with ease to older generation UVs that are backfitted with the same interface design. In addition, when needed, multiple ones of payload rail 10 supporting multiple payloads 12 can be mounted on the external surfaces of UVs possibly at different orientations that may depend on geometries of the UVs.

Modifications and alternate embodiments of common payload rail 10 of the invention may be adapted, and differently configured to accommodate different host vehicles under different operational conditions. The disclosed components and their arrangements as disclosed herein all contribute to the novel features of this invention. Payload rail 10 of the invention is an uncomplicated and reliable application of good engineering for improving operational readiness and effectiveness of UVs and their externally mounted payloads.

It should be readily understood that many modifications and variations of the present invention are possible within the purview of the claimed invention. It is to be understood that within the scope of the appended claims the invention may be practiced otherwise than as specifically described.

We claim:

1. A common payload rail for externally supporting a payload having longitudinally extending receiving means on a marine vehicle comprising:

a vehicle interface module having a conforming surface and feed-through conduits extending therethrough, said conforming surface of said vehicle interface module being rigidly secured to the marine vehicle;

a functionality module secured to said vehicle interface module having internal components for interfacing the payload and the marine vehicle; and a payload interface module secured to said functionality module having feed-through conduits extending therethrough, at least one securing mechanism, and at least one longitudinally extending rail structure sized to engage the longitudinally extending receiving means on the payload, wherein said longitudinally extending rail structure is shaped to extend into at least one correspondingly shaped longitudinally extending receiving means on the payload to arrest lateral displacement between said payload interface module and the payload and said securing mechanism is disposed to engage the payload to arrest longitudinal displacement between said payload interface module and the payload and wherein said feed-through conduits extending through said payload interface module and said vehicle interface module receive select ones of electrical conductors and optical fibers for power and data transmission and communication requirements of the payload, said functionality module, and the marine vehicle.

2. The payload, rail of claim 1 wherein some of said feed-through conduits extending through said vehicle interface module and said payload interface module between the marine vehicle and the payload include tubes to transfer fluids between the payload, said functionality module, and the marine vehicle.

3. The payload rail of claim 2 wherein said vehicle interface module, said functionality module and said payload interface module have essentially protuberance-free outer surfaces provided with tapered leading and trailing edges to reduce hydrodynamic drag.

4. The payload rail of claim 3 wherein said longitudinally extending rail structure has a cross-sectional L-shape and said longitudinally extending receiving means is an L-shaped channel sized to slideably receive the L-shaped longitudinally extending rail structure therein.

5. The payload rail of claim 3 wherein said longitudinally extending rail structure comprises a pair of upward-extending, sliding-rail structures extending in an inverted, oppositely-facing L-shaped cross-sectional configuration longitudinally extending on said payload interface module.

6. The payload rail of claim 5 wherein said longitudinally extending receiving means is shaped as a pair of L-shaped channels that longitudinally extend in the lower part of a bottom assembly on the payload and said L-shaped channels are slightly larger than said pair of L-shaped sliding rail structures to allow said L-shaped sliding rail structures to be inserted in and contiguously slid within said L-shaped channels.

7. The payload rail of claim 6 wherein said internal components of said functionality module are selected from the group consisting of self contained internal power source components to power said functionality module's internal components and the external payload; computer data processing and signal processing components, including data storage components; and sensor components to provide input data to augment the functions of the marine vehicle and the external payload.

8. The payload rail of claim 7 wherein said internal components of said functionality module include buoyancy compensation components.

9. The payload rail of claim 8 wherein said internal components of said functionality module include effectors and actuator components to produce ambient effects as needed, and means for isolation of the effects of vibrations throughout said payload interface module and said vehicle interface module to dampen vibrations between the marine vehicle and the payload.

10. The payload rail of claim 9 wherein said isolation means has electrical, electro-magnetic, magnetic, and acoustical components to minimize impact of the effects between systems including shielding and isolating emissions and emanations from one body to another to yield an overall lower detectable radiated signal to remotely located external sensing devices.

11. The payload rail of claim 10 wherein said vehicle interface module is mounted on a torpedo-shaped unmanned undersea vehicle to support a submerged payload.

12. The payload rail of claim 11 wherein said vehicle interface module is at least partially connected to the torpedo-shaped unmanned undersea vehicle by tensioned bands extending around the circumference of the unmanned undersea vehicle.

* * * * *